United States Patent [19]

Thompson

[11] Patent Number: 4,706,840

[45] Date of Patent: Nov. 17, 1987

[54] BAFFLED TANK VENT

[76] Inventor: David M. Thompson, 803 Mantoloking Rd., Brick Town, N.J. 08723

[21] Appl. No.: 29,193

[22] Filed: Mar. 23, 1987

[51] Int. Cl.[4] ..... B65D 51/16

[52] U.S. Cl. ..... 220/373; 220/374; 220/DIG. 27

[58] Field of Search ..... 220/366, 367, 373, 374, 220/DIG. 27

[56] References Cited

U.S. PATENT DOCUMENTS 3,866,789 2/1975 Lambert ..... 220/373

3,916,724 11/1975 Muller et al. ..... 220/373

*Primary Examiner*—George T. Hall

*Attorney, Agent, or Firm*—Charles F. Gunderson

[57] ABSTRACT

A threaded tube extends through the hull of a boat well above the water line. An outer, baffled, vent cap with a threaded inner tubular portion is screwed onto the outer end of the threaded tube. The vent cap also includes an outer tubular portion concentric to and spaced from the inner tubular portion; both being held in place by a solid outer cap. A first breather opening through the upper part of the inner tubular portion, next to the solid cap, connects the inside of the threaded tube to the space between the inner and outer tubular portions, and a second breather opening through the lower part of the outer tubular portion connects the space between the inner and outer tubular portions to the outer air. A threaded nut near the inner end of the threaded tube tightens against the inside of the hull to draw the outer vent cap tightly against the outside of the hull. A tube may be used to connect the inner end of the threaded tube to any desired tank.

5 Claims, 4 Drawing Figures

BAFFLED TANK VENT

BACKGROUND OF THE INVENTION

Almost every tank containing liquids needs a vent of some sort to allow air to escape as liquids are added, or to reenter to replace liquids being drawn out, as well as to allow the escape of fumes or gasses. On a boat, and particularly in regard to gasoline tanks, where the vapors are explosive, these vents must be outside the hull. This poses special problems, since any vent to the outside of the hull must be exposed to the elements of the weather, and especially to rain and spray, which, if it might enter the vent, could be quite damaging to the fuel—and ultimately the engine—or contaminate whatever is in the tank.

The more typical of the existing tank vents include elbows that may have holes for screening and ventilation, but are quite vulnerable to wave action or spray. Other pipes, with or without valves, will perform similar functions both with similar problems. A one-way valve could prevent most contaminants from getting in, but it could also block the flow of air in that direction, which would inhibit one of the functions of the vent, and could be critical.

The vent must not be unattractive, and it must not project too far from the outside of the hull. It must be strong enough to stand occasional physical abuse, and should be easily removable for cleaning, repair, or replacement. It must also have a screening effect to keep bugs, that would not be good for the fuel or the engine, out of the gas tank, or any other tank.

It is therefore an object of this invention to provide a vent that extends through the side of a hull in a simple and secure manner, but also includes a unique combination of baffles to provide protection against rain and spray.

SUMMARY OF THE INVENTION

An assembly for venting a container, such as a gasoline or water tank, where fumes or liquid volume changes require venting to the atmosphere, has a threaded feed-through tube extending through the hull, well above the water line. An outer, baffled vent is screwed onto the outer end of the threaded tube, and an inner, flexible nut screws onto the inner projection of the threaded tube against the inside of the hull to draw the outer vent tightly against the outside of the hull. The inner end of the feed-through tube may be coupled to any tank by means of a standard hose. The outer baffled vent has a threaded inner tube coupled tightly to the threaded feed-through tube with a breather opening through its upper wall at its outer end which is attached to an outer top cap that also supports one end of an outer tube, concentric to but spaced closely to the inner tube. The other end of the outer tube has a flat base fitting tightly against the hull, and a lower outer breather opening through its lower wall. The tank is vented through the feed-through tube, the breather opening in the upper wall of the inner tube; the space between inner and outer tubes; and the breather opening in the lower wall of the outer tube.

DETAILED DESCRIPTION OF THE DRAWINGS

Figure 1:
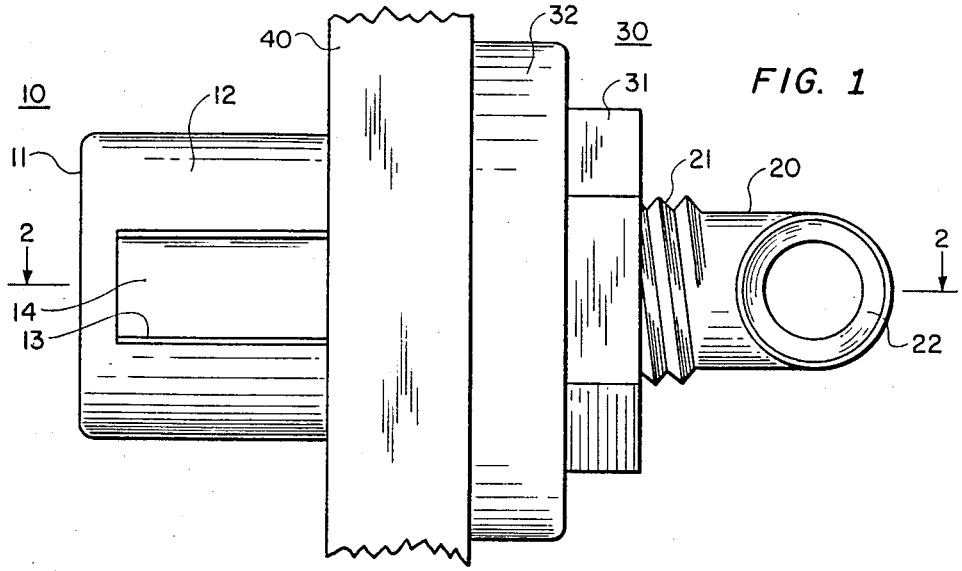
FIG. 1 is a bottom view of the device through the hull.

FIG. 1 is a bottom view of the overall device extending through a portion of a hull 40. This shows the outer, baffled vent 10, with a top cap 11, an outer tube 12, with an outer breather opening 13, through which an inner tube 14 can be seen.

On the other, inner end of the feed-through tube 20 threads 21 are seen supporting the nut 30, with its tightening flanges 31 for tightening its flexible rim 32 against the inside of the hull 40 to draw the bottom of the outer, baffled vent 10 against the outside of the hull 40.

Figure 2:
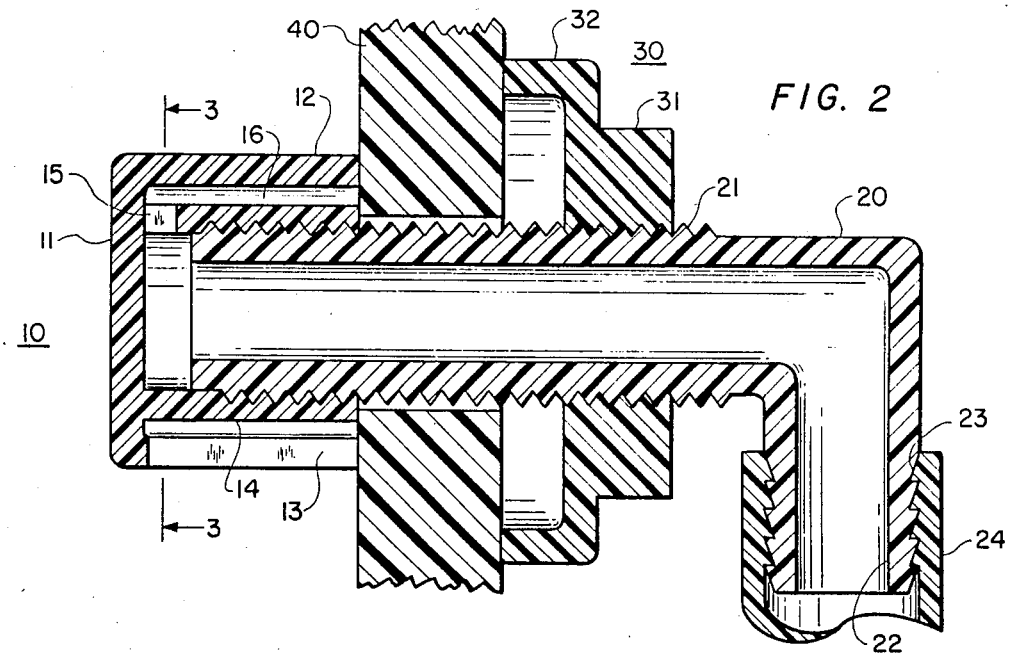
FIG. 2 is a cross section of a side view of the device along the lines 2—2 of FIG. 1.

FIG. 2 is a cross section of the same device, in a side view, along the lines 2—2 of FIG. 1. This more-clearly shows the feed-through tube 20, extending through the hull 40, and into the outer, baffled vent 10.

Here, as in all of the figures, similar elements are similarly numbered.

The tube 20 has threads 21 that engage the threads on the inside of an inner tube 14 of the outer, baffled vent cap 10. This cross section clearly shows the top cap 11 supporting the outer tube 12, with its lower outer, breather opening 13, and an inner tube 14, with its upper, inner, breather opening 15. The space between the outer tube 12 and the inner tube 14, which may be concentric, provides a breather gap for the passage of air from the outside, through the lower, outer, breather opening 15; the breather gap 16; and the inner, upper breather opening 15 to the outer end of the feed-through tube.

The other inner end of the threads 21 of the feed-through tube 20 support the nut 30 with its tightening flanges 31 and flexible rim 32. This, again, clearly shows how the nut 30 can be turned down along the threaded portions of the tube 20, against the inside of the hull, to tighten the bottom of the vent cap 10 against the outside of the hull. The flexible rim 32 will also conform to a certain degree of non-uniformity of the inside of the hull to seal the opening in the hull.

The inner end of the tube 20 may be coupled to any tank, and may have a hose coupling, such as 22, which may include ridges, such as 23 to engage a hose 24, which, in turn, can be connected to the top of a tank.

Figure 3:
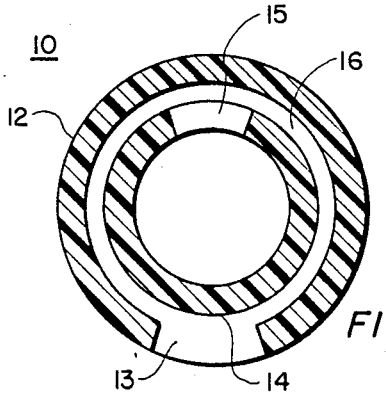
FIG. 3 is a cross section of a top view of the outer baffled vent, through the lines 3—3 of FIG. 2.

FIG. 3 is a cross section of the outer portion of the vent cap 10 along the lines 3—3 of FIG. 2. This is intended to show, more clearly, the outer tube 12, with its lower, outer, breathing opening 13, and the inner tube 14, with its upper, inner, breather opening 15. The inner and outer tubes are separated by the breather gap 16 between the concentric tubes.

Figure 4:
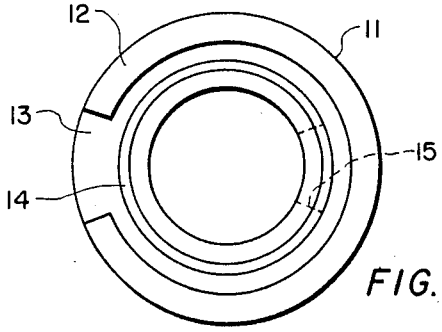
FIG. 4 is a bottom view of the outer baffled vent.

FIG. 4 is a bottom view of the same cap, showing, again the orientation of the breathing portions, and the concentric elements resting on, and supported by, the top cap 11.

The orientaion of the breather openings and gaps provide a minimal, but adequate flow of air to ventilate and control the pressure of air within the tank, and provide protection against almost anything except full immersion. The layout of the the openings precludes water entry from rain or spray, and even some wave action.

The hose coupling end of the feed-through tube may be straight, or at any angle, such as the right angle shown in some of these drawings. The angled inner end would project less into the inner hull, and be less vulnerable to damage or breakage of the connecting hose, which could be critical.

The size of the breather gap, or spacing between the outer and inner tubes controls the amount of air flow, which would normally be minimal for a small tank. It also, inherently, function as a screen, and should be narrow enough to keep out any and all possible bugs.

All of the major elements of this device are removable, for cleaning or replacement, which could be very handy in the event of clogging of any kind.

I claim:

1. A vent, extending through a hull, for a tank within said hull comprising a continuously-threaded tubular unit extending through a hole in said hull well above the waterline; said tubular unit having an outer end projecting outside said hull, and an inner end projecting inside said hull; a baffled vent cap having a first, outer, tubular portion, and a second, inner, tubular portion concentric with, and spaced from, said first, outer, tubular portion; an outer cap secured to and supporting said outer and inner tubular portions in said spaced, concentric relationship, and maintaining an air gap between said tubular portions; said inner tubular portion being threaded to be attached to the outer end of said continuously-threaded tubular unit; a breather opening through the upper side of said inner tubular portion adjacent to said outer cap for maintaining an air passage between said tubular unit and said air gap; and a breather opening through the lower side of said outer tubular portion for maintaining an air passage between said air gap and the outer air; and a nut engaging the threads of said inner end of said tubular unit to be turned tightly against the inside of said hull to draw said outer and inner tubular portions tightly against the outside of said hull.

2. A vent, extending through a hull, as in claim 1, wherein said nut has a flexible flange adjacent to said inside of said hull, to conform to the contours of said inside of said hull, and form a tight seal.

3. A vent, extending through a hull, as in claim 1, wherein said breather opening through said upper side of said inner tubular portion is confined to a small sector of the uppermost quadrant of said inner tubular portion, and said breather opening through said lower side of said outer tubular portion is confined to a small sector of the lowermost quadrant of said outer tubular portion.

4. In combination with a vent, extending through a hull, as in claim 1, means for connecting said inner end of said tubular unit to said tank within said hull.

5. A vent, extending through a hull, as in claim 4, wherein said means for connecting said inner end of said tubular unit to said tank within said hull comprises a flexible tube having one end coupled to said inner end of said tubular unit, and another end coupled to said tank within said hull.

* * * * *